US006619735B1

(12) United States Patent
Ming-Hwa

(10) Patent No.: US 6,619,735 B1
(45) Date of Patent: Sep. 16, 2003

(54) POWER-ACTUATED CHAIR-TYPE ELEVATING APPARATUS

(75) Inventor: Shou Ming-Hwa, Hsin Tien (TW)

(73) Assignee: Dynamic Healthtech Inc, Taipei (TW)

( * ) Notice: Subject to any disclaimer, the term of this patent is extended or adjusted under 35 U.S.C. 154(b) by 0 days.

(21) Appl. No.: 10/243,851

(22) Filed: Sep. 12, 2002

(51) Int. Cl.[7] ..... A47B 9/00

(52) U.S. Cl. ..... 297/170; 297/174 R; 297/195.11; 297/DIG. 10; 297/344.17

(58) Field of Search ..... 297/174 R, 156, 297/330, DIG. 10, 170, 172, 5, 338, 339, 344.15, 344.16, 344.17; 108/147, 7, 10; 248/185.1; 135/66, 67

(56) References Cited

U.S. PATENT DOCUMENTS

| | | | | | |
|---|---|---|---|---|---|
| 1,256,811 | A | * | 2/1918 | McNamara | 297/172 |
| 3,029,106 | A | * | 4/1962 | McGuire | 297/311 |
| 3,851,917 | A | * | 12/1974 | Horstmann et al. | 297/344.15 |
| 4,798,411 | A | * | 1/1989 | Lin | 297/170 |
| 4,884,841 | A | * | 12/1989 | Holley | 297/331 |
| 5,155,873 | A | * | 10/1992 | Bridges | 4/667 |
| 5,199,763 | A | * | 4/1993 | Wilder et al. | 297/338 |
| 5,265,689 | A | * | 11/1993 | Kauffmann | 180/65.5 |
| 5,702,326 | A | * | 12/1997 | Renteria | 482/68 |
| 5,984,411 | A | * | 11/1999 | Galumbeck | 297/344.15 |
| 6,053,519 | A | * | 4/2000 | Poindexter et al. | 280/250.1 |
| 6,494,005 | B2 | * | 12/2002 | Zimmerman | 52/296 |
| 2002/0134286 | A1 | * | 9/2002 | Moore | 108/147 |

FOREIGN PATENT DOCUMENTS

| | | | | |
|---|---|---|---|---|
| GB | 2113086 | A | * 8/1983 | A61G/5/00 |

* cited by examiner

*Primary Examiner*—Peter M. Cuomo
*Assistant Examiner*—Stephen D'Adamo
(74) *Attorney, Agent, or Firm*—W. Wayne Liauh

(57) ABSTRACT

A power-actuated chair-type elevating apparatus for moving a user to a desired position includes a slidable base having an upright lower tube-extended from a top thereof, a table having a downward extended upper tube axially movably covering the lower tube, an elevating mechanism mounted in the upper and lower tubes to elevate or lower the table relative to the base, and a seat pivotally supported on two bent tubes and three links. The bent tubes are fixedly connected at another end to the upper tube. The three links are coaxially and pivotally connected at a first end to one another, and pivotally connected at a second end to the seat, the base, and the upper tube, respectively. When the table is elevated, the seat is also elevated and forward inclined for the user sit thereon to lean against the table without the risk of falling off the seat.

4 Claims, 4 Drawing Sheets

POWER-ACTUATED CHAIR-TYPE ELEVATING APPARATUS

BACKGROUND OF THE INVENTION

The present invention relates to a power-actuated chair-type elevating apparatus that employs simple linkage to elevate and forward incline a seat thereof and thereby protects a user sitting on the seat from dangerously tilting backward.

A patient or an old man having weak legs usually needs an attendant to help him to move from a sickbed to a sofa, a wheelchair, or a bathroom. A most common way for the attendant to do so is to carry the patient or the old man with two arms. The attendant would feel laborious and the patient or the old man would,feel uncomfortable when the patient or the old man is carried to a considerably distant place.

There is a manually operated elevating apparatus developed for assisting in moving the patient or the old man from one place to another place. The apparatus includes a seat that is manually elevated or lowered to facilitate convenient moving of the patient or the old man onto or off the seat. In using the manually operated elevating apparatus, the attendant has to control the up and down of the seat while keeps watching the patient or the old man, lest he should fall off the seat. Even with great care, there are times the attendant fails to well protect the patient or the old man against falling while manipulates the elevating apparatus at the same time.

SUMMARY OF THE INVENTION

It is therefore a primary object of the present invention to provide a power-actuated chair-type elevating apparatus that uses electric power to control elevating and lowering of a seat thereof, so that the apparatus can be more conveniently operated.

Another object of the present invention is to provide a power-actuated chair-type elevating apparatus that uses electric power to elevate and lower a seat thereof, and the seat gradually inclines forward to raise a rear end thereof when it is elevated, so that a user sit thereon also inclines forward to safely lean against a table of the apparatus without the risk of tilting rearward to fall off the seat.

To achieve the above and other objects, the power-actuated chair-type elevating apparatus of the present invention mainly includes a slidable base having an upright lower tube extended from a top thereof, a table having a downward extended upper tube axially movably covering the lower tube, an elevating mechanism mounted in the upper and lower tubes to elevate or lower the table relative to the base, and a seat pivotally supported on a pair of bent tubes and three links. The bent tubes are pivotally connected at an end to a lower near rear end of the seat and fixedly connected at another end to the upper tube. The three links are coaxially and pivotally connected at a first end to one another, and pivotally connected at a second end to a lower near front end of the seat, the base, and the upper tube, respectively. When the elevating mechanism operates to elevate the table and the upper tube downward extended from the table, the seat is also elevated and forward inclined due to an effect of the three links, enabling the user sit thereon to safely lean against the table without the risk of falling off the seat.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
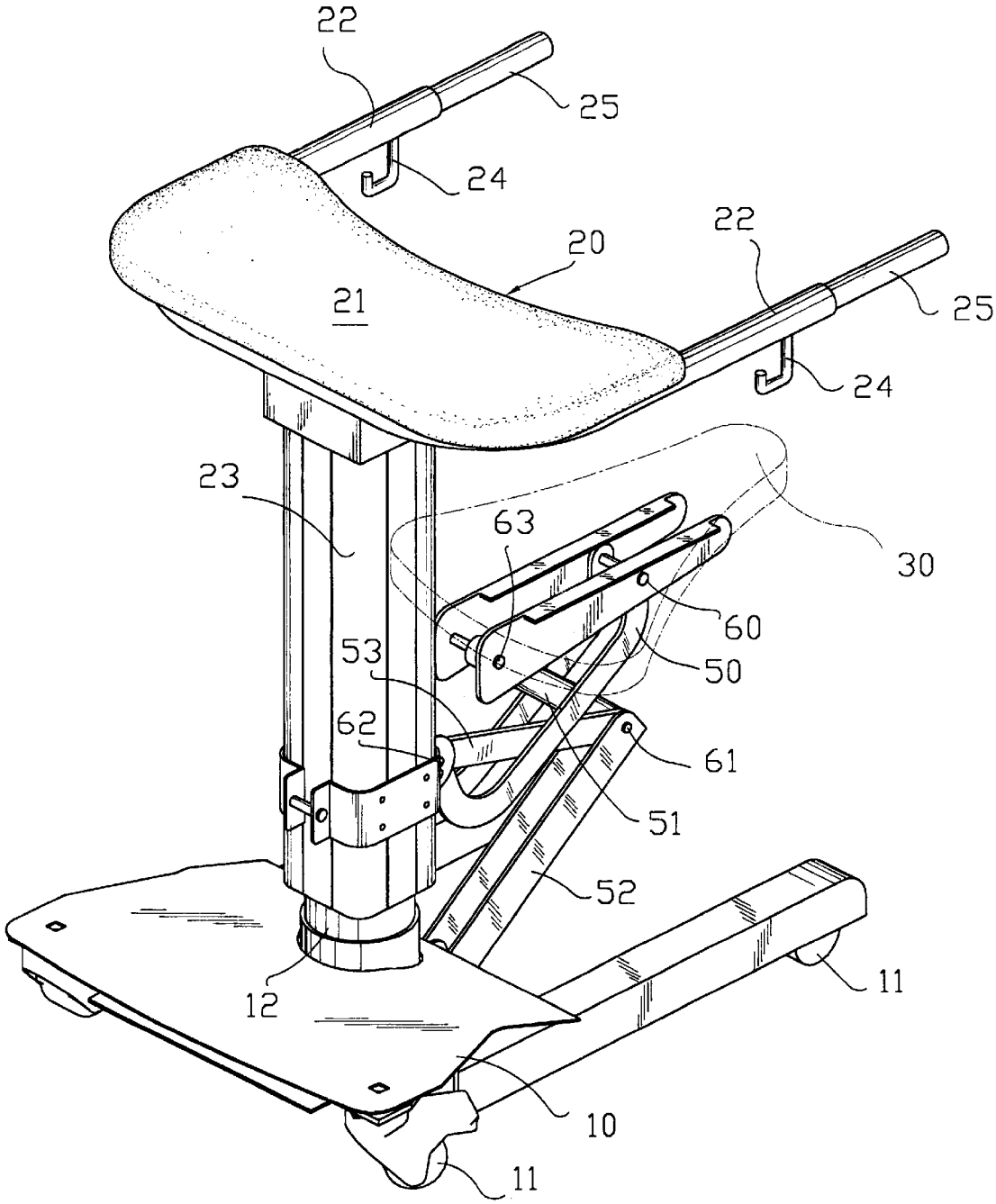
FIG. 1 is a perspective view of a power-actuated chair-type elevating apparatus according to the present invention.
Figure 2:
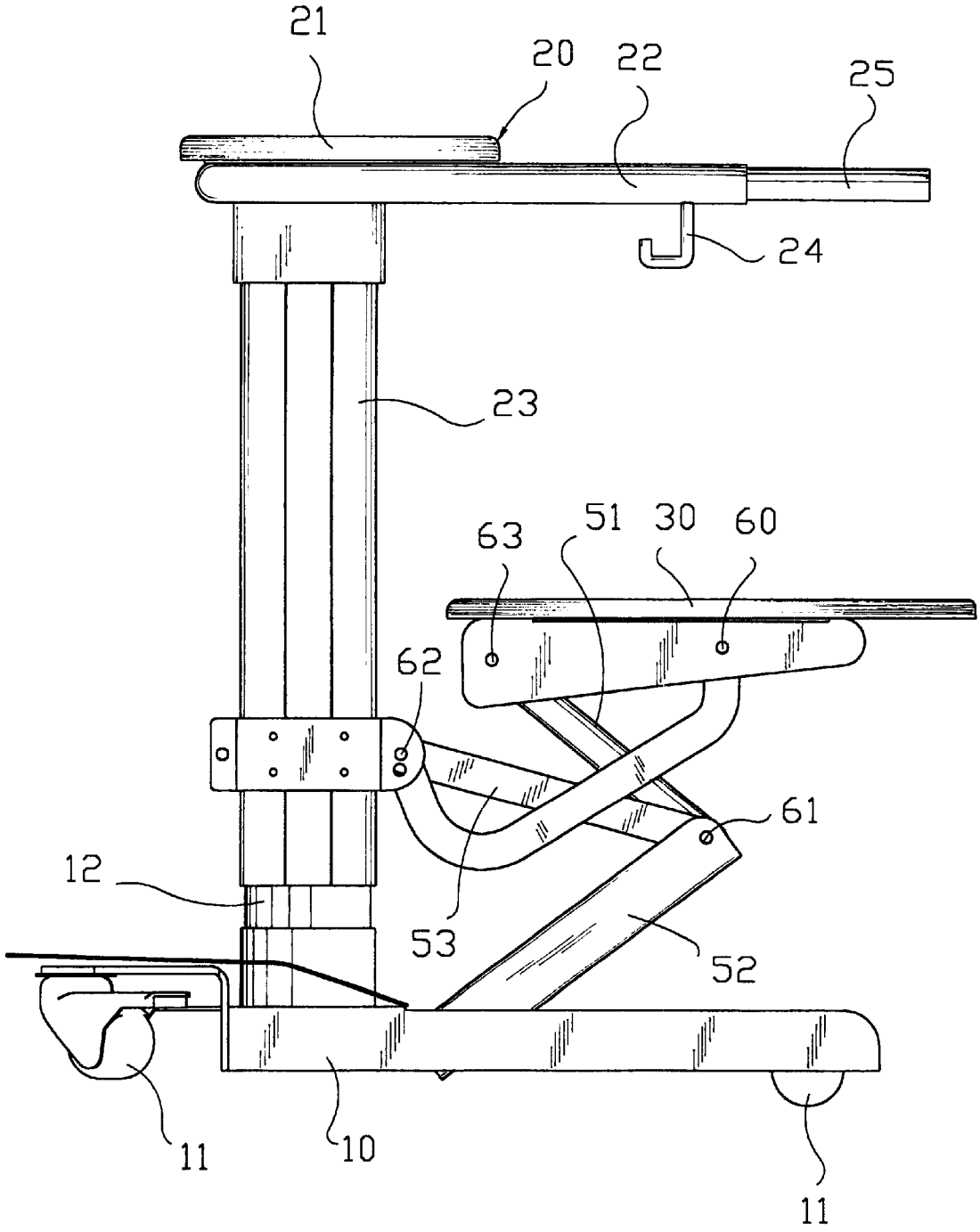
FIG. 2 is a side view of FIG. 1.
Figure 3:
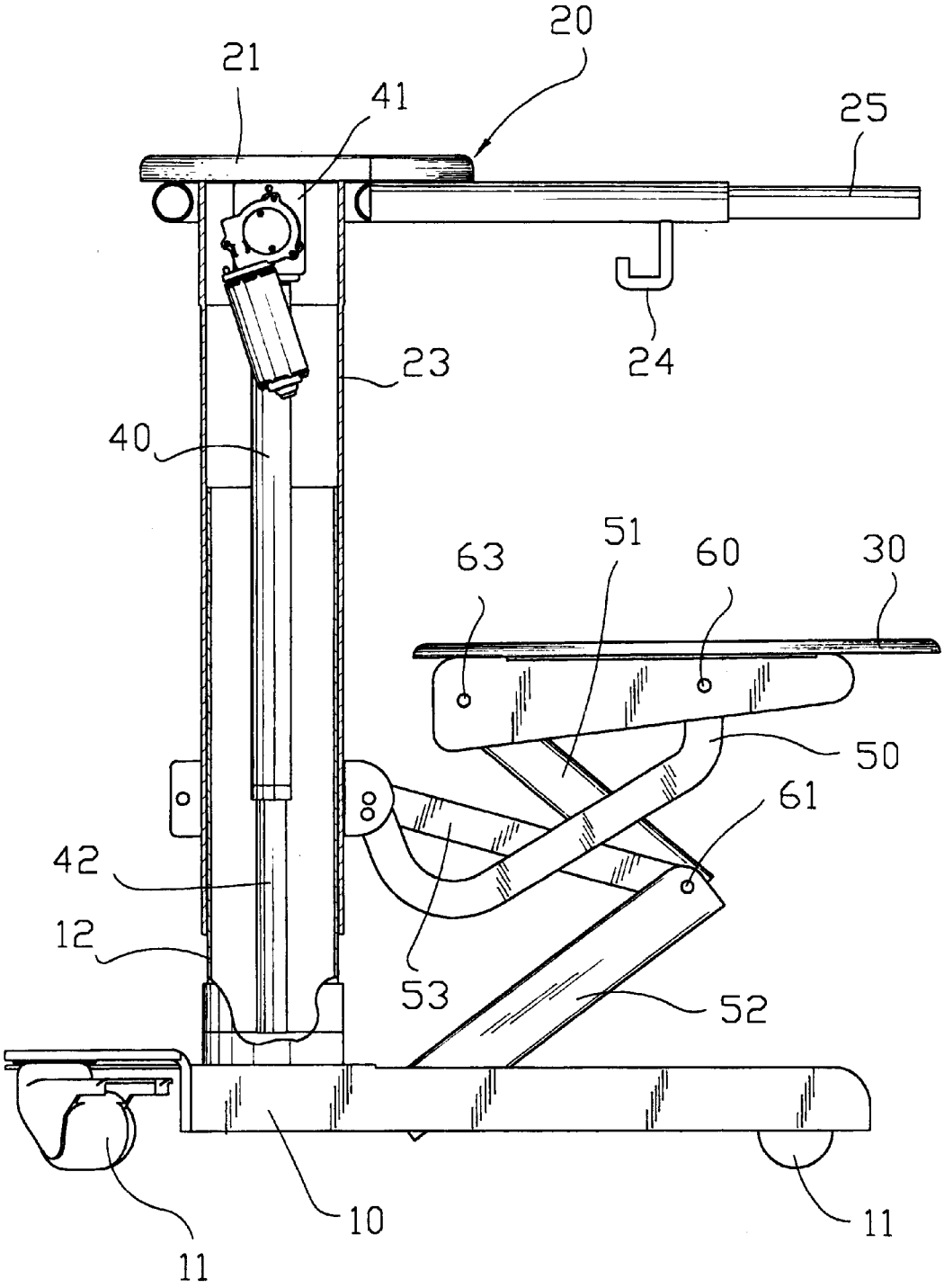
FIG. 3 is a partially sectioned side view of the present invention.

Please refer to FIGS. 1, 2, and 3 which together shows a power-actuated chair-type elevating apparatus according to the present invention. As shown, the power-actuated chair-type elevating apparatus mainly includes a base 10, a table 20, a seat 30, and an elevating mechanism 40.

The base 10 is provided with casters 11 and can therefore smoothly slide on a floor surface. An upright lower tube 12 is extended from a top of the base 10.

The table 20 includes a tabletop 21 having two handles 22 rearward extended from two lateral sides of the tabletop 21. An upper tube 23 is fixedly connected to a bottom surface of the tabletop 21 to extend downward therefrom and axially movably cover the lower tube 12.

The elevating mechanism 40 is provided in the lower tube 12 and the upper tube 23 to locate between the table 20 and the base 10. As can be seen in FIG. 3, the elevating mechanism 40 includes a foot 41 fixedly mounted to a bottom of the table 20, and an outer telescopic tube 42 fixedly connected at a lower end to the top of the base 10. When the elevating mechanism 40 operates, the table 20 and the upper tube 23 are caused to synchronously move upward or downward relative to the base 10.

The seat 30 is connected to and supported by a generally U-shaped supporting means 50, a first end of which is pivotally connected to a lower near rear end of the seat 30 to provide a first supporting and pivotal point 60, and a second end of the supporting means 50 is fixedly connected to the upper tube 23 below the table 20. Three links 51, 52, and 53 are coaxially and pivotally connected at their respective first ends to provide a second pivotal point 61, with a second end of the third link 53 pivotally connected to the upper tube 23 to provide a third pivotal point 62, a second end of the first link 51 pivotally connected to a lower near front end of the seat 30 to provide a fourth pivotal point 63, and a second end of the second link 52 pivotally connected to the base 10. The second pivotal point 61 common to the three links 51, 52, and 53 is located at a height lower than the third pivotal point 62 between the third link 53 and the upper tube 23. With the above arrangements, the three links 51, 52, and 53 are able to support a front end of the seat 30.

Figure 4:
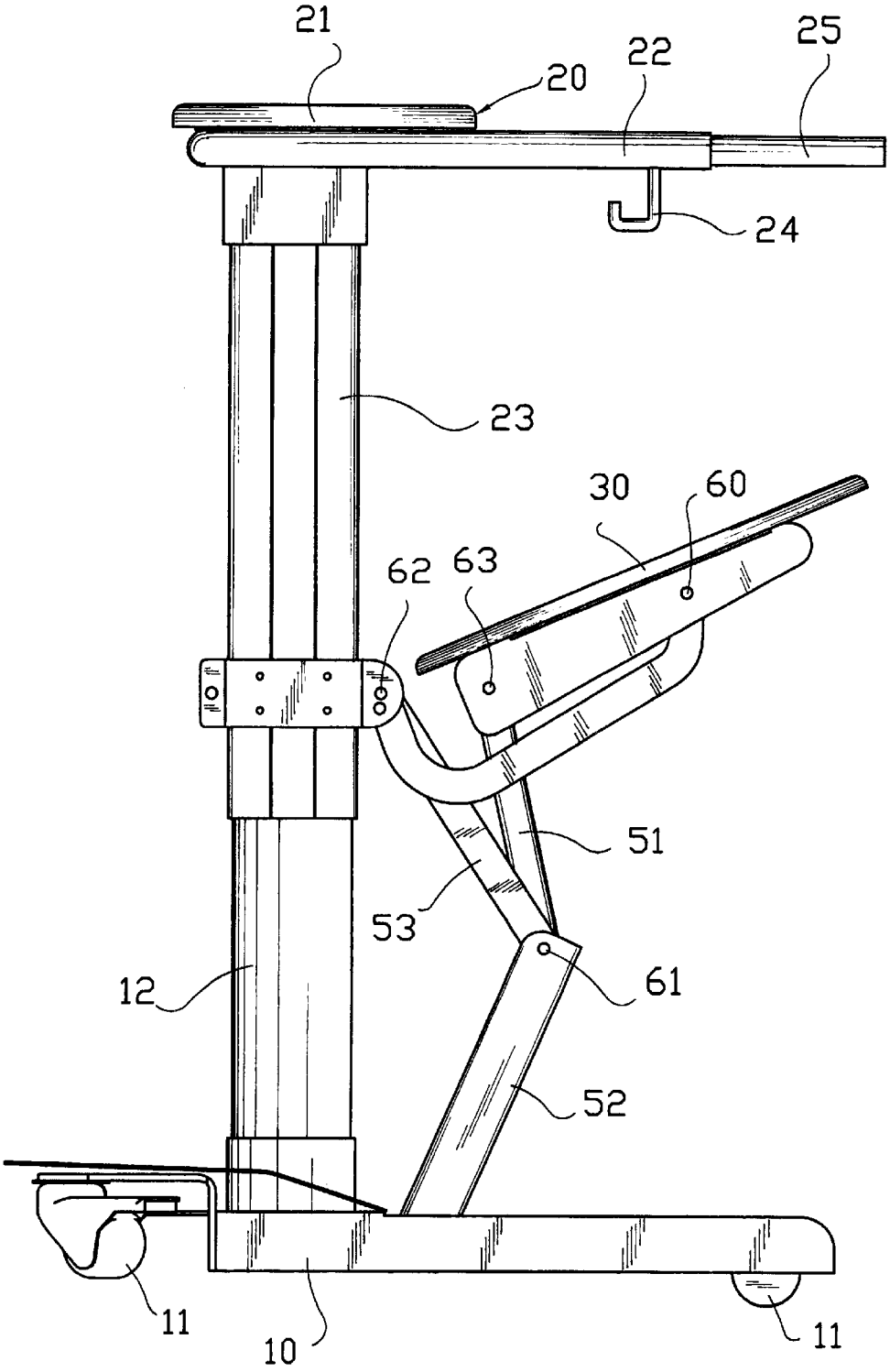
FIG. 4 is a side view of the present invention with a seat thereof in an elevated and forward inclined position.

When the elevating mechanism 40 operates to extend the outer telescopic tube 42, the table 20 and the upper tube 23 are elevated, as shown in FIG. 4, causing the supporting means 50 fixedly connected at the second end to the upper tube 23 to move upward synchronously. At this point, the first pivotal point 60 between the first end of the supporting means 50 and the seat 30 is also moved upward. On the other hand, the second pivotal point 61 common to the three links 51, 52, and 53 is now located at a height lower than the third pivotal point 62 between the third link 53 and the upper tube 23 that is elevated by the extended outer telescopic tube 42. At this point, the fourth pivotal point 63 between the second end of the first link 51 and the seat 30 is elevated by a distance smaller than an elevated distance of the first pivotal point 60 between the first end of the supporting means 50 and the seat 30. That is, in the process of elevating the table 20, a rear end of the seat 30 gradually moves to a position higher than a front end of the seat 30, bringing the seat 30 to incline forward.

To move a patient or an old man onto the seat 30, first lower the table 20 and the seat 30 at the same time, as shown in FIG. 2. At this point, the seat 30 is in or almost in a horizontal plane close to a height of the patient or the old man's buttocks. With the elevating apparatus of the present invention set to this position, an attendant may conveniently move the patient or the old man to sit on the seat 30 via the rear end of the seat 30. The elevating mechanism 40 may then be actuated to elevate the table 20, and the patient or the old man sit on the seat 30 is elevated at the same time. Meanwhile, since the rear end of the seat 30 gradually rises to become higher than the front end of the seat 30, the patient or the old man sit on the seat 30 is caused to incline forward to rest on or lean against the tabletop 21. The forward inclined position ensures the patient or the old man to safely sit on the seat 30 without the risk of tilting rearward and falling down the seat 30 when the elevating apparatus slides on the floor. The higher the seat 30 is elevated, the larger the inclination of the seat 30 is. Thus, the seat 30 may be elevated to a desired height depending on an actual condition in which the elevating apparatus is to be used.

The two handles 22 of the table 20 are provided at a lower side with two hooks 24 for holding a protective belt (not shown) thereto to support the patient or the old man's back and thereby prevent the patient or the old man from inclining rearward and falling off the seat 30. The patient or the old man sitting on the seat 30 may rest two arms on the two handles 22. The handles 22 may include two extension bars 25. The attendant may grip at the outward extended extension bars 25 to manipulate the elevating apparatus.

It is preferable the seat 30 has a top having narrower rear end and wider front end, so that the patient or the old man can be more easily moved onto the seat 30 and shifted forward to stably sit on the seat 30. The supporting means 50 may be two laterally symmetrical bent tubes. In the elevating apparatus of the present invention, either one piece of second link 52 having a U-shaped cross section, or a pair of two laterally symmetrical second links 52 may be provided to ensure an enhanced and balanced support of the patient or the old man on the seat 30.

In brief, the power-actuated chair-type elevating apparatus of the present invention employs simple and ingenious linkage to forward incline while elevate the seat of the elevating apparatus, so that the weak patient or old man seated on the elevating apparatus is automatically forward inclined to rest on or lean against the table and safely moved to a desired position.

What is claimed is:

1. A power-actuated chair-type elevating apparatus, comprising a base, a table, a seat, and an elevating mechanism;

said base being provided at a lower side with casters so as to be slidably moved on a floor surface, and at an upper side with an upright lower tube;

said table including a tabletop having two handles rearward extended from two lateral sides of said tabletop, and an upper tube fixedly connected to a bottom surface of said tabletop to downward extend therefrom to axially movably cover the lower tube;

said elevating mechanism being mounted in said lower and upper tubes to locate between said table and said base, and including a foot fixedly mounted to a bottom of said table, and an outer telescopic tube fixedly connected at a lower end tour to a top of said base, such that when said elevating mechanism operates, said table and said upper tube are caused to synchronously move up ward or downward relative to said base;

said power-actuated chair-type elevating apparatus being characterized in that said seat is connected to and supported by a generally U-shaped supporting means and first, second, and third links; a first end of said supporting means being pivotally connected to a lower rear end of said seat, and a second of which being fixedly connected to said upper tube; said first, second, and third links being coaxially and pivotally connected at first ends, with a second end of said third link pivotally connected to said upper tube, a second end of said first link pivotally connected to a lower front end of said seat, and a second end of said second link pivotally connected to said base; and said coaxially and pivotally connected first ends of said first, second, and third links being located at a height lower than said second end of said third link pivotally connected to said upper tube; whereby when said elevating mechanism operates to elevate said table and accordingly said upper tube, a rear end of said seat gradually rises to be higher than a front end of said seat, making said seat forward inclined.

2. The power-actuated chair-type elevating apparatus as claimed in claim 1, wherein said U-shaped supporting means includes two laterally symmetrical bent tubes.

3. The power-actuated chair-type elevating apparatus as claimed in claim 1, wherein said second link is a single member having a U-shaped cross section.

4. The power-actuated chair-type elevating apparatus as claimed in claim 1, wherein said second link includes two laterally symmetrical members.

* * * * *